US009737923B2

(12) United States Patent
Breen et al.

(10) Patent No.: US 9,737,923 B2
(45) Date of Patent: Aug. 22, 2017

(54) STOCK EJECTOR ASSEMBLY

(71) Applicant: Standard Lifters, Inc., Grand Rapids, MI (US)

(72) Inventors: Scott M. Breen, Marne, MI (US); Joel T. Pyper, Grand Rapids, MI (US)

(73) Assignee: STANDARD LIFTERS, INC., Grand Rapids, MI (US)

( * ) Notice: Subject to any disclaimer, the term of this patent is extended or adjusted under 35 U.S.C. 154(b) by 114 days.

(21) Appl. No.: 14/929,782

(22) Filed: Nov. 2, 2015

(65) Prior Publication Data

US 2016/0129493 A1 May 12, 2016

Related U.S. Application Data

(60) Provisional application No. 62/075,966, filed on Nov. 6, 2014.

(51) Int. Cl.
*B21D 37/08* (2006.01)
*B21D 45/02* (2006.01)

(52) U.S. Cl.
CPC ..... *B21D 37/08* (2013.01); *B21D 45/02* (2013.01)

(58) Field of Classification Search
CPC ..... B23P 15/24; B21D 37/08; B21D 37/20; B21D 45/02
See application file for complete search history.

(56) References Cited

U.S. PATENT DOCUMENTS

| | | | |
|---|---|---|---|
| 2,168,377 | A | 8/1939 | Wales |
| 3,335,627 | A | 8/1967 | Smelts |
| 3,998,369 | A | 12/1976 | Grosjean et al. |
| 4,342,214 | A | 8/1982 | Neuendorf |
| 4,424,639 | A | 1/1984 | Richardson |
| 4,644,836 | A | 2/1987 | Wepner |
| 4,916,931 | A | 4/1990 | Kaeseler |
| 4,945,749 | A | 8/1990 | Walker et al. |
| 5,722,280 | A | 3/1998 | Bodnar |
| 5,860,315 | A | 1/1999 | Sawdon |
| 7,694,399 | B2 | 4/2010 | Sawdon et al. |
| 7,913,369 | B2 | 3/2011 | Gakovic |
| 8,151,619 | B2 | 4/2012 | Pyper et al. |
| 2006/0193937 | A1 | 8/2006 | Gakovic |
| 2009/0044671 | A1 | 2/2009 | Greenleaf |

(Continued)

FOREIGN PATENT DOCUMENTS

| | | |
|---|---|---|
| JP | 56084130 | 9/1981 |
| JP | 56122634 | 9/1981 |

(Continued)

OTHER PUBLICATIONS

Standard Lifters Inc., "Pilot Assembly" sales brochure, Grand Rapids, MI (Oct. 2011), 15 pages.

(Continued)

*Primary Examiner* — Teresa M Ekiert
(74) *Attorney, Agent, or Firm* — Price Heneveld LLP

(57) ABSTRACT

A stock ejector assembly and method for metal forming dies includes a stock ejector with a large spring and a ring-style stripper. The ring-style stripper provides a larger surface area for contacting the stock. The large compression spring is preloaded and when a load is applied, the stripper retracts and the spring pressure increases. When the dies separate, the stock ejector pushes the part off flat surfaces, separating surfaces sealed by adhesion, including, but not limited to, oil or lubricant adhesion.

20 Claims, 8 Drawing Sheets

(56) References Cited

U.S. PATENT DOCUMENTS

| | | | |
|---|---|---|---|
| 2009/0193865 | A1 | 8/2009 | Pyper et al. |
| 2014/0144202 | A1 | 5/2014 | Pyper et al. |

FOREIGN PATENT DOCUMENTS

| | | |
|---|---|---|
| JP | 57100825 | 6/1982 |
| JP | 06142788 | 5/1994 |
| KR | 1020010069897 | 7/2001 |
| KR | 1020060104028 | 10/2006 |
| KR | 100766072 | 10/2007 |
| SU | 604608 | 4/1978 |
| SU | 1065064 | 7/1984 |

OTHER PUBLICATIONS

Standard Lifters Inc., "Pilot Sleeve" sales brochure, Grand Rapids, MI (Jan. 2012), 18 pages.

Fibro Inc., "Pilot Units to Daimler Standards" catalog p. E72, Rockford, IL (date unknown).

Dayton Progress Corporation, "Regular Pilots" catalog, pp. 9, 11, 13, Dayton, OH (date unknown).

Ajacs Die Sales Corporation, Pilot Retainer sales brochure, Grand Rapids, MI (date unknown).

Misumi Corporation, "Pilot Punches" catalog, pp. 202, 220, 228, 234, 242, 946, 948, Schaumberg, IL (date unknown).

Modern Die Systems Inc., "Die Accessories" sales brochure, Ellwood IN (date unknown), 1 page.

STOCK EJECTOR ASSEMBLY

CROSS REFERENCE TO RELATED APPLICATION

Applicants hereby claim the priority benefits under the provisions of 35 U.S.C. §119, basing said claim of priority on related U.S. Provisional Application No. 62/075,966 filed Nov. 6, 2014.

BACKGROUND OF THE INVENTION

The present invention relates to metal forming dies and the like, and in particular to a stock ejector assembly and associated method incorporating a unique stock ejector assembly.

Metal forming dies, such as stamping dies and the like, are well known in the art.

Progressive metal forming dies are unique, very sophisticated mechanisms which have multiple stations or progressions that are aligned longitudinally, and are designed to perform a specified operation at each station in a predetermined sequence to create a finished metal part. Progressive stamping dies are capable of forming complex metal parts at very high speeds, so as to minimize manufacturing costs.

Heretofore, the dies used in metal forming presses have typically been individually designed, one-of-a-kind assemblies for a particular part, with each of the various components being handcrafted and custom mounted or fitted in an associated die set, which is in turn positioned in a stamping press. Not only are the punches and the other forming tools in the die set individually designed and constructed, but the other parts of the die set, such as stock lifters, guides, end caps and keepers, cam returns, etc., are also custom designed, and installed in the die set. Current die making processes require carefully machined precision holes and recesses in the die set for mounting the individual components, such that the same are quite labor intensive and require substantial lead time to make, test, and set up in a stamping press. Consequently, such metal forming dies are very expensive to design, manufacture, and repair or modify.

A liquid, such as a lubricant, mill oil, or water may be used on the stock and one or more of the die parts to decrease the wear on the die parts and/or damage to the stock. When a liquid is used on the stock or upper and/or lower die parts of a metal forming die, the stock has a tendency to stick to the die parts. Thus, something must be done to break the lubricant tension/adhesion on the stock so that it can be removed from that portion of the die. In addition, tension/adhesion can also exist between the stock and flat surfaces on the dies whether or not a liquid is used with the stock and/or dies. Such adhesion between flat surfaces also requires the breaking of the developed tension. One way of breaking the tension is to use a threaded spring plunger. This is a self-contained assembly that includes a very small diameter spring which is prone to fail quickly due to its size. When the threaded spring plunger fails, it is a hassle for stampers as they have to continuously replace the threaded spring plungers. Another problem is that the threaded spring plungers typically have a pointed tip that can leave a mark on the stock if the spring pressure is too great.

FIGS. 15-18 illustrate two well-known prior art assemblies. For example, FIG. 15 illustrates the upper die member 72 of a die set with spring plungers 140. The spring plunger 140 includes a spring portion and a tip 146. The spring is received in an aperture 142 in the die member 72 such that the threaded surface 144 of the aperture 142 corresponds to the contours of the spring plunger 140. Such spring plungers 140 typically fail due to the small spring, which effects the overall lifespan of the spring plunger. The tip 146 has a small contact point that can mark the stock material. In addition, due to the small surface area of the tip 146, the spring plunger 140 can have trouble breaking the lubricant tension/adhesion on the stock strip. As illustrated in FIG. 15, the insertion of spring plunger 140 into die member 72 can be a difficult assembly, as the aperture 142 needs to be threaded 144 to correspond to the shape of the spring plunger 140.

Another example of the prior art includes ejector pin assemblies 148, as shown in FIGS. 17 and 18. The ejector pins 148 include a pin 151 with a tip 152 that extends through a hole 157 in the bottom surface 161 of the die member 72. Another hole 158 includes a threaded portion 156 that mates with a set screw 154 of the ejector assembly 148. A spring 150 is received in hole 158 in between the set screw 154 and the head 160 of the pin 151. The spring 150 pushes the head 160 of the pin 151 such that the tip 152 of the pin 151 can extend from the underside 161 of the die member 72. Use of the ejector pins 148 requires costly machining as the die member 72 must receive several small parts. Small holes must be drilled for the pin 151 of the ejector pin assembly 148. The die member 72 has to be counter-bored and tapped for the set screw 154. In addition, the components of the ejector pin assemblies 148 are small components and require an immense amount of time to assemble.

The need for an improved stock ejector thus stems from the issues that metal stamping producers and die shops have long had when creating an "oil breaker" setup in their dies. The improved stock ejector addresses two main items that are currently problematic: The first is that it utilizes a large spring, which provides a much longer product life than a traditional spring plunger. The large spring is on the "exterior" of the assembly and the other construction methods are internal. This design provides the ability for a large spring to be used while keeping the overall footprint of the assembly as small as possible. The second is the increase in surface area that makes contact with the stock. Typical plunger "point" style on spring plungers have very little surface area, and most commonly used are the points that are rounded/spherical. This provides very little contact with the stock and it can leave a "mark" if the spring pressure compared to the contact surface area on the stock are not proper. The improved stock ejector utilizes a "ring" style stripper, which provides more overall surface area in contact with the stock. This amount of contact surface area prevents the stock from being "marked" but is also not so high that the stock wants to stick to it.

Thus, a product that solves these problems would be advantageous and is described herein.

SUMMARY OF THE INVENTION

One aspect of the present invention is a stock ejector assembly that utilizes a large spring, thereby providing a longer product life. The spring is on the "exterior" of the assembly, allowing for a large spring to be used while keeping the overall footprint of the assembly as small as possible. Another aspect of the present invention is to provide a stock ejector assembly that has an increased surface area that makes contact with the stock. Thus, the present invention includes a "ring" style stripper which provides a larger surface area to contact the stock. The increased contact surface area prevents the stock from being "marked" and prevents the stock from sticking to the ejector.

Yet another aspect of the present invention is a multi-station progressive metal forming die having at least two, mutually converging and diverging die members between which an elongate stock strip is shifted longitudinally to form parts from the stock strip, along with an improved stock ejector assembly. The stock ejector assembly includes a stock ejector body with an outer end portion oriented toward the stock strip, an inner end portion oriented away from the stock strip, and a medial portion between the outer end portion and the inner end portion. The outer end portion of the stock ejector body includes a shoulder with an outer end surface and an inner end surface. The inner end portion of the stock ejector body includes a threaded shank portion that secures the assembly to one of the die members. The medial portion of stock ejector assembly includes a shoulder with an outer end surface and an inner end surface. The stock ejector assembly includes a stripper with an outer end portion arranged toward the stock strip and an inner end portion oriented away from the stock strip. The outer end portion of the stripper includes an aperture with a first diameter, and the inner end portion includes an aperture with a second diameter. The second diameter is less than the first diameter of the outer end portion, forming a generally annular shoulder that engages the inner end surface of the shoulder of the outer end portion of the stock ejector body. The stock ejector assembly includes a spring member having a generally hollow interior that is received over the stock ejector body, an outer end oriented toward the stock strip that engages the inner end portion of the stripper, and an opposite inner end oriented away from the stock strip that engages the outer end surface of the shoulder of the medial portion of the stock ejector body. The stock ejector assembly optionally includes a spacer having a generally hollow interior that is received over a portion of the threaded shank portion of the inner end portion of the stock ejector body. The space has an outer end surface oriented toward the stock strip that engages the inner end surface of the shoulder of the medial portion of the stock ejector body, and an inner end surface oriented away from the stock strip.

Yet another aspect of the present invention is a stock ejector assembly for metal forming dies that have least two mutually converging and diverging die members to form parts from the stock strip. The stock ejector assembly includes a stock ejector body with an outer end portion oriented toward the stock strip, an inner end portion oriented away from the stock strip, and a medial portion between the outer end portion and the inner end portion. The outer end portion of the stock ejector body includes a shoulder with an outer end surface and an inner end surface. The inner end portion of the stock ejector body includes a threaded shank portion that secures the assembly to one of the die members. The medial portion of stock ejector assembly includes a shoulder with an outer end surface and an inner end surface. The stock ejector assembly includes a stripper with an outer end portion arranged toward the stock strip and an inner end portion oriented away from the stock strip. The outer end portion of the stripper includes an aperture with a first diameter, and the inner end portion includes an aperture with a second diameter. The second diameter is less than the first diameter of the outer end portion, forming a generally annular shoulder that engages the inner end surface of the shoulder of the outer end portion of the stock ejector body. The stock ejector assembly includes a spring member having a generally hollow interior that is received over the stock ejector body, an outer end oriented toward the stock strip that engages the inner end portion of the stripper, and an opposite inner end oriented away from the stock strip that engages the outer end surface of the shoulder of the medial portion of the stock ejector body. The stock ejector assembly optionally includes a spacer having a generally hollow interior that is received over a portion of the threaded shank portion of the inner end portion of the stock ejector body. The space has an outer end surface oriented toward the stock strip that engages the inner end surface of the shoulder of the medial portion of the stock ejector body, and an inner end surface oriented away from the stock strip.

Yet another aspect of the present invention is a method for making a multi-station progressive metal forming die having at least two mutually converging and diverging die members between which an elongate stock strip is shifted longitudinally to form parts from the stock strip, with the improvement of at least one stock ejector assembly. The method includes forming a stock ejector body with an outer end portion oriented toward the stock strip, an inner end portion oriented away from the stock strip, and a medial portion between the outer end portion and the inner end portion. The method includes forming said outer end portion of the stock ejector body to have a shoulder with an outer end surface and an inner end surface. The method includes forming said inner end portion of the stock ejector body to have a threaded shank portion that secures the assembly to one of the die members. The method includes forming the medial portion of the stock ejector body to have a shoulder with an outer end surface and an inner end surface. The method includes forming a stripper with an outer end portion arranged toward the stock strip and an inner end portion oriented away from the stock strip. The method includes forming the outer end portion to include an aperture with a first diameter and forming said inner end portion to include an aperture with a second diameter. The second diameter of the inner end portion is less than the first diameter of the outer end portion, forming a generally annular shoulder that engages the inner end surface of the shoulder of the outer end portion of the stock ejector body. The method includes selecting a spring member with a generally hollow interior, an outer end oriented toward the stock strip, and an opposite inner end oriented away from the stock strip. The method includes inserting the spring member over the outer end portion of the stock ejector body with the inner end of the spring member engaging the outer end surface of the shoulder of the medial portion of the stock ejector body. The method includes inserting the stripper over the outer end portion of the stock ejector body. The method includes inserting a tool into the stripper and moving the tool toward the inner end portion of the stock ejector body, thereby compressing the stock ejector assembly such that the inner end portion of the stripper moves past the shoulder of the outer end portion of the stock ejector body. The method includes removing the tool to permit the spring to push the stripper toward the outer end of the stock ejector body, allowing the annular shoulder of the stripper to engage the inner end surface of the shoulder of the outer end portion of the stock ejector body. The method optionally includes selecting a spacer that is placed over a portion of the inner end portion of the stock ejector body. The method includes securing the stock ejector assembly to one die member.

These and other advantages of the invention will be further understood and appreciated by those skilled in the art by reference to the following written description, claims, and appended drawings.

DETAILED DESCRIPTION OF THE PREFERRED EMBODIMENTS

Figure 1:
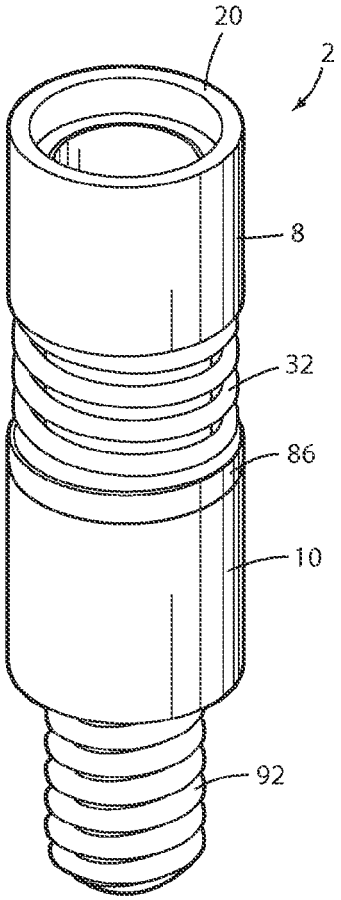
FIG. 1 is a perspective view of the stock ejector assembly embodying the present invention.

For purposes of description herein, the terms "upper," "lower," "right," "left," "rear," "front," "vertical," "horizontal," and derivatives thereof shall relate to the invention as oriented in the attached drawings. However, it is to be understood that the invention may assume various alternative orientations and step sequences, except where expressly specified to the contrary. It is also to be understood that the specific devices and processes illustrated in FIGS. 1-14, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 2 (FIGS. 1-14) generally designates a stock ejector assembly embodying an aspect of the present invention. As shown in FIGS. 11-14, the stock ejector assembly 2 is particularly adapted for use in conjunction with a multi-stage progressive metal forming die 70 having at least two mutually converging and diverging die members 72 and 74, between which an elongated stock strip 30 is shifted longitudinally form parts from the stock strip.

Figure 2:
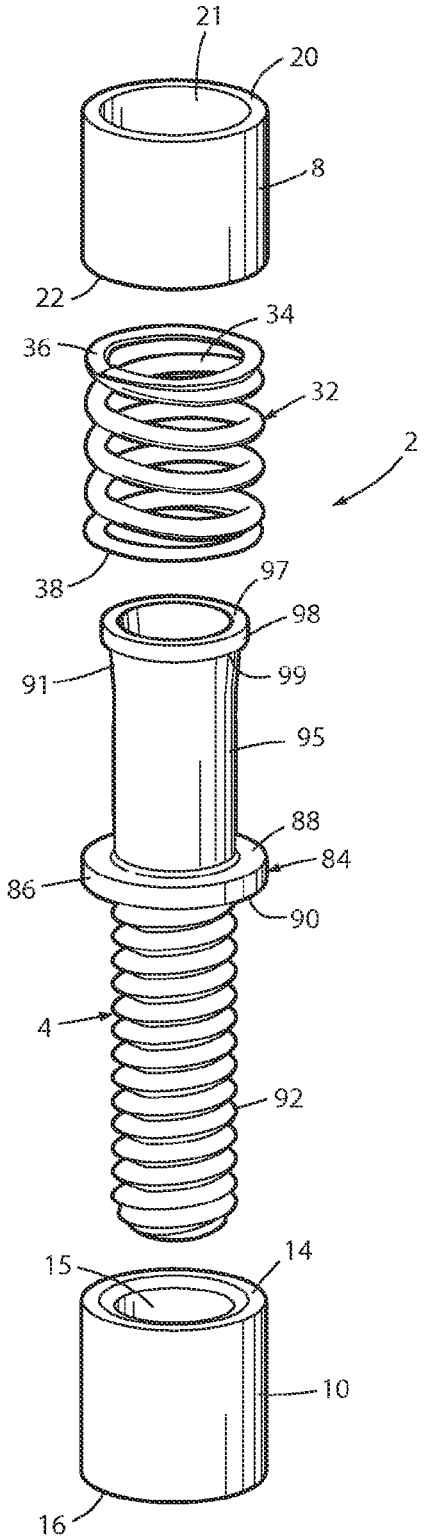
FIG. 2 is an exploded perspective view of the stock ejector assembly shown in FIG. 1.
Figure 3:
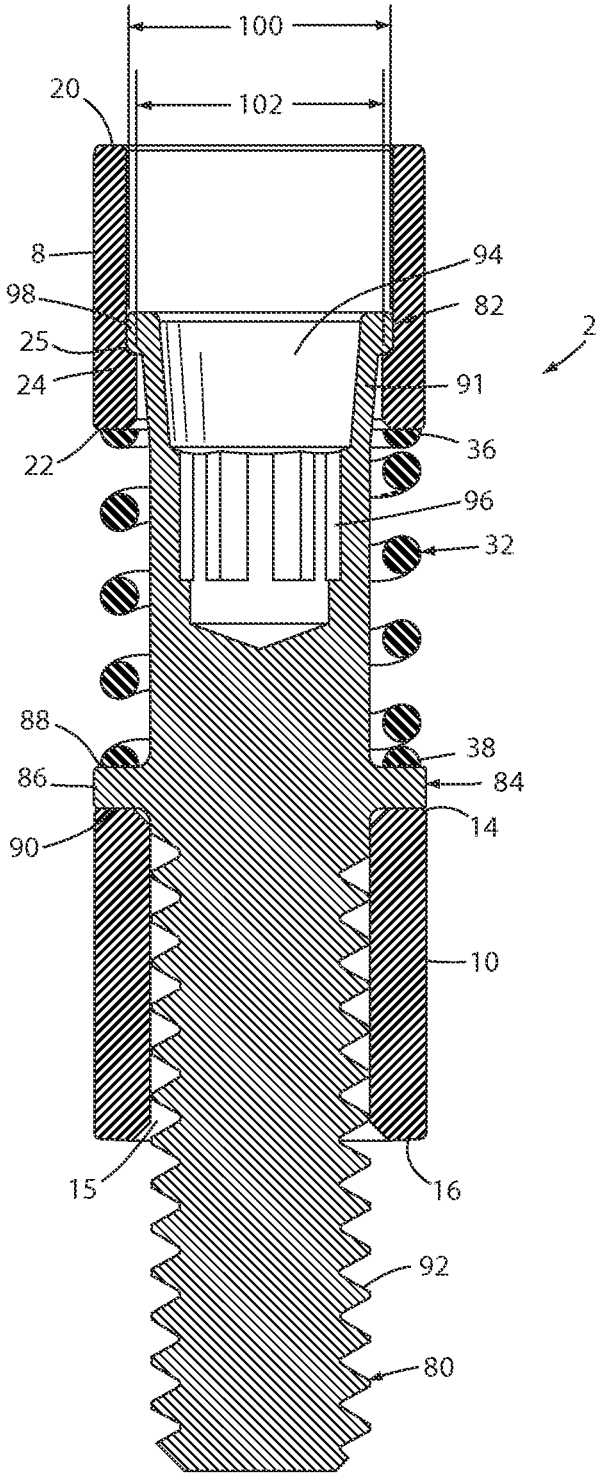
FIG. 3 is a vertical cross-sectional view of the stock ejector assembly shown in FIG. 1.

The stock ejector assembly 2 includes a stock ejector body 4, a stripper 8, a fastener 54, and optionally a spacer 10, as shown in FIGS. 1-3.

Figure 12:
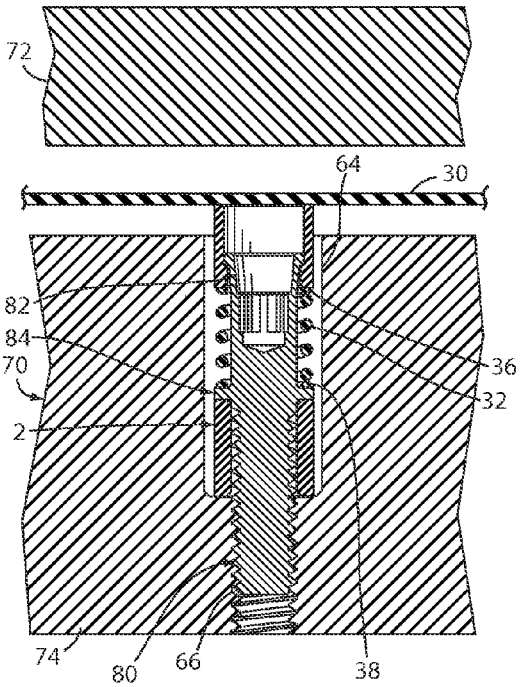
FIG. 12 is a perspective view of the stock ejector assembly installed in a lower die member as the stock is being separated from the lower die member.

The stock ejector body 4 includes an outer end portion 82, oriented toward the stock strip 30, an inner end portion 80, and a medial portion 84, as shown in FIGS. 3 and 12. The inner end portion 80 has a threaded portion 92. The threaded portion 92 can be a threaded shank as shown in the Figures. The outer end portion 82 has a shoulder 98 with an outer end surface 97 and an inner end surface 99, as shown in FIG. 2. The medial portion 84 has a shoulder 86 with an outer end surface 88 and an inner end surface 90. The stock ejector body 4 also has a spring receiving portion 95 that extends to the inner end surface 99 of the shoulder 98. The spring receiving portion 95 can include a taper 91, as shown in FIG. 2.

Figure 9:
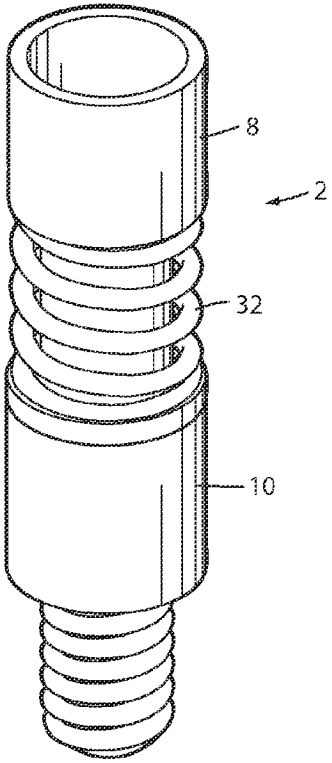
FIG. 9 is a perspective view of the stock ejector assembly after the spacer is added.
Figure 11:
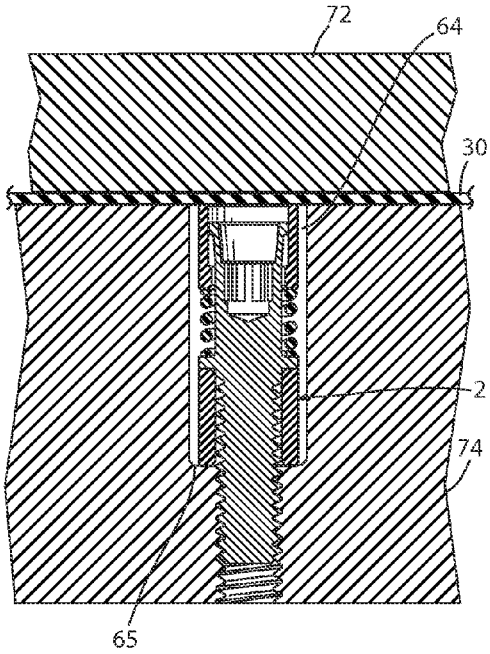
FIG. 11 is a perspective view of the stock ejector assembly installed in a lower die member showing the stock being pressed against the lower die member.

The stripper 8 has an outer end portion 20 oriented toward the stock strip 30, an oppositely disposed inner end portion 22 oriented away from the stock strip 30 with a hollow interior 21 extending therebetween. The outer end portion 20 of the stripper 8 is generally ring-shaped, as shown in FIGS. 1-2 and 9. The outer end 20 engages the stock strip 30, as shown in FIGS. 11-12.

As illustrated in FIG. 3, stripper 8 has an internal generally annular shoulder 24 that is formed by the difference in the inner diameter 100 of the outer end 20 and the inner diameter 102 of the inner end 22 of the stripper 8.

The spring member 32 includes a hollow interior 34, as shown in FIG. 2. The spring member 32 also has an outer end 36 that is oriented toward the stock strip 30 and an inner end 38 that is oriented away from the stock strip 30, as shown in FIG. 12.

The stock ejector assembly 2 also includes an optional space 10 with an outer end surface 14 and an inner end surface 16. The spacer 10 has a hollow interior 15 that is received over the threaded shank 92 of the stock ejector body 4 when the stock ejector assembly 2 is completed.

Figure 6:
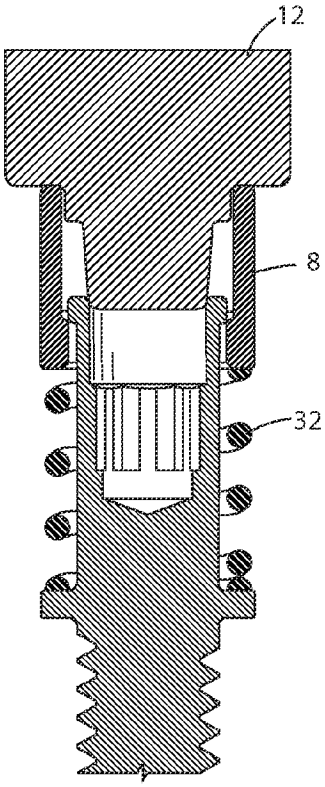
FIG. 6 is a vertical cross-sectional view of the forming tool being inserted.
Figure 5:
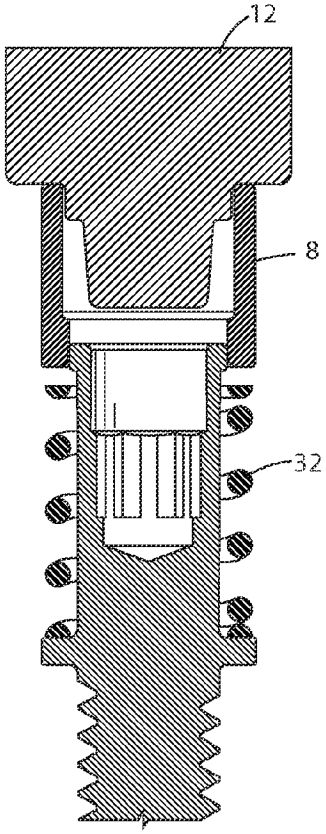
FIG. 5 is a vertical cross-sectional view of a spring and stripper being loaded on the stock ejector body with a forming tool.
Figure 4:
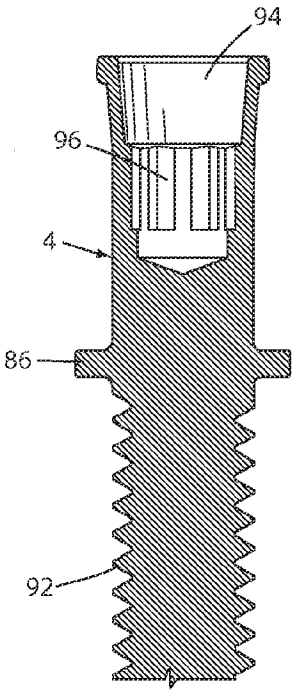
FIG. 4 is a vertical cross-sectional view of the stock ejector body.
Figure 8:
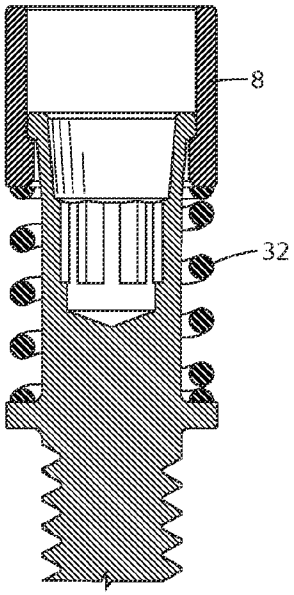
FIG. 8 is a vertical cross-sectional view of the partial stock ejector assembly with the forming tool removed.
Figure 7:
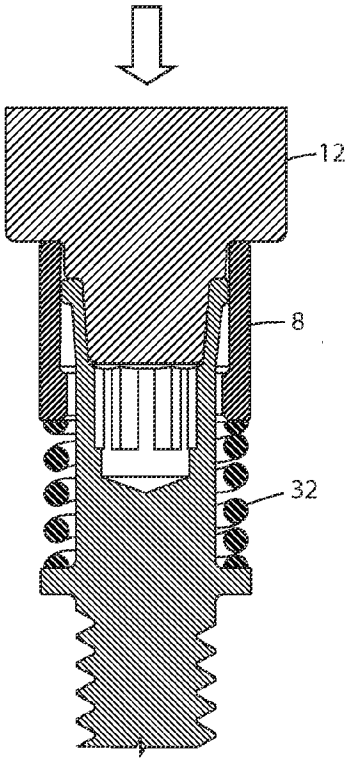
FIG. 7 is a vertical cross-sectional view of the forming tool with an arrow showing the direction of the forming tool to compress the partial stock ejector assembly while flaring the stock ejector body.

As best illustrated in FIGS. 4-9, the stock ejector assembly 2 is assembled by use of a forming tool 12. As shown in FIG. 5, the spring 32 is loaded on the stock ejector body 2 such that the spring 32 surrounds the spring retaining portion 95 of the stock ejector body 2. As shown in FIGS. 5-7, the forming tool 12 is used to compress the partial stock ejector assembly 2 causing the outer end 82 of the stock ejector body 2 to flare. This allows the stripper 8 to be assembled onto the stock ejector body 2 such that the inner shoulder 25 of the stripper 8 moves past the shoulder 98 of the stock ejector body 2. Once the forming tool 12 is removed and the spring 32 becomes uncompressed, the inner end surface 25 of the shoulder 24 of the stripper 8 will engage the inner end surface 99 of the shoulder 98 of the stock ejector body 2, as shown in FIG. 8. The optimal spacer 10 can then be added over the threaded portion 92 of the stock ejector body 2, as shown in FIG. 9.

Figure 13:
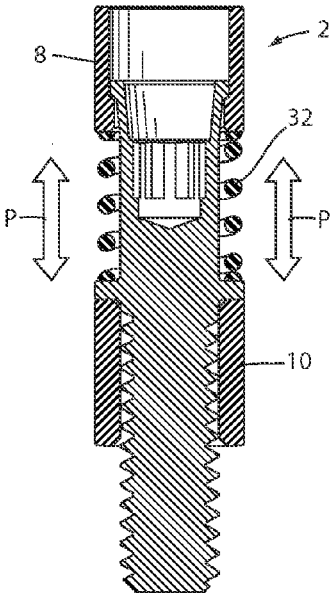
FIG. 13 is a vertical cross-sectional view of the stock ejector assembly with arrows showing the preloaded spring.
Figure 14:
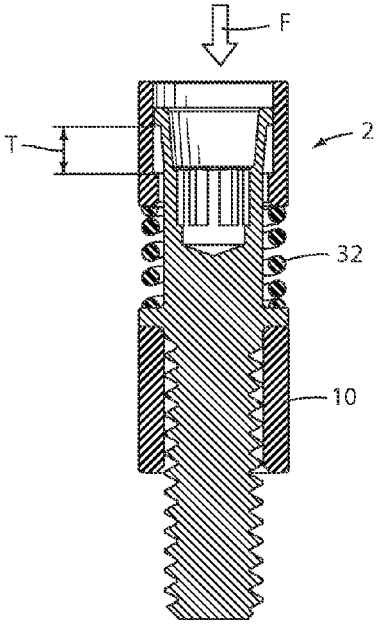
FIG. 14 is a vertical cross-sectional view of the stock ejector assembly with arrows showing the distance of travel T when a force F is applied.
Figure 15:
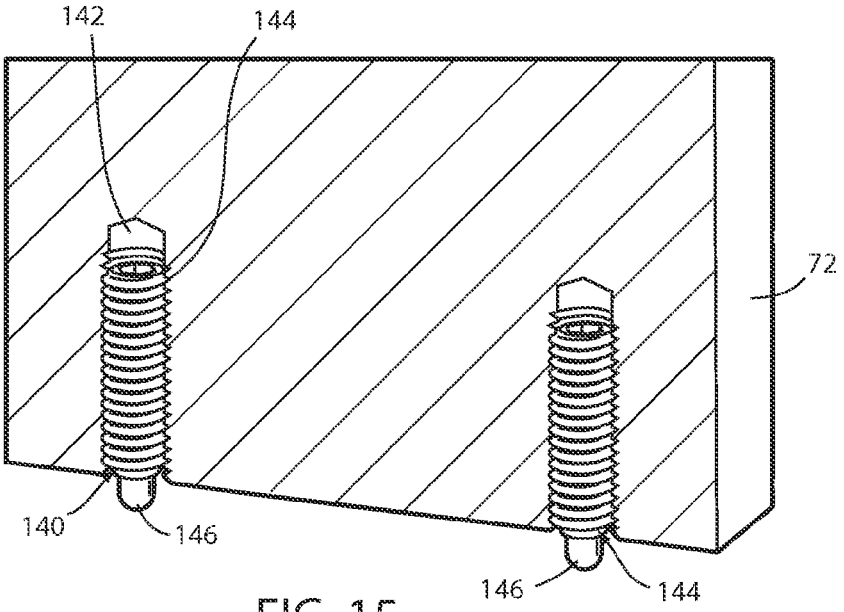
FIG. 15 Prior Art
FIG. 15 is a schematic cross-sectional view of prior art spring plungers installed in a die member.
Figure 16:
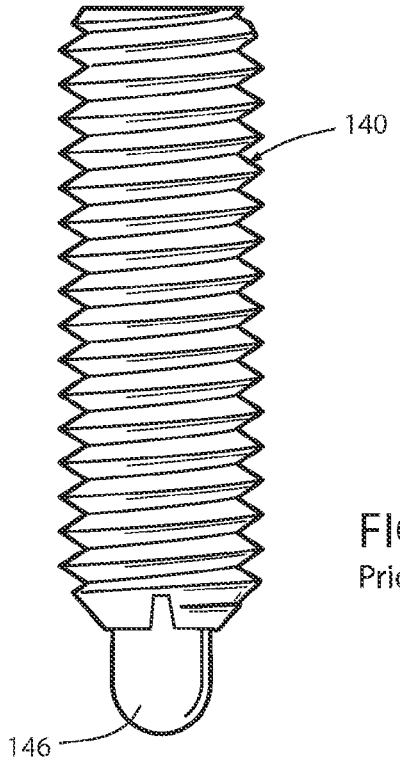
FIG. 16 Prior art
FIG. 16 is a perspective view of a prior art spring plunger.
Figure 17:
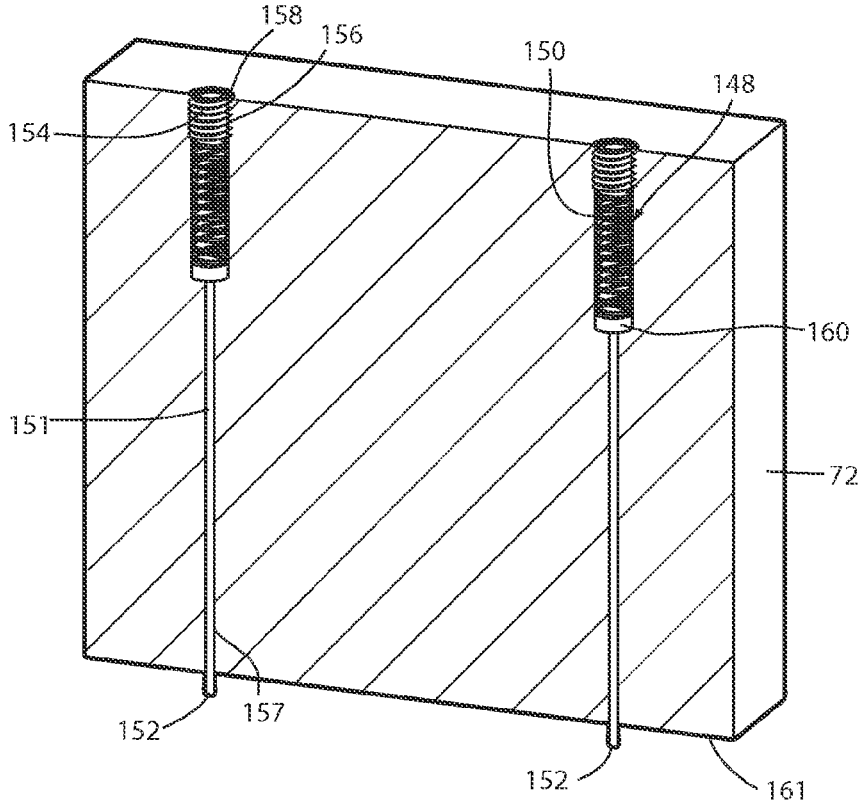
FIG. 17 Prior Art
FIG. 17 is a schematic cross-sectional view of prior art ejector pin assemblies in a die member.
Figure 18:
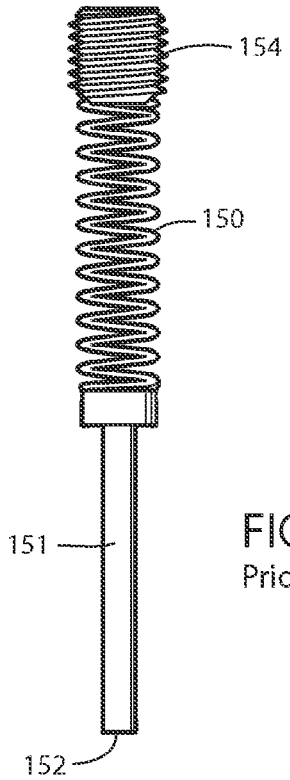
FIG. 18 Prior Art
FIG. 18 is a perspective view of a prior art ejector pin assembly.

When the stock ejector assembly 2 is fully assembled, the spring member 32 is preloaded, as shown by the arrows P in FIG. 13. When a load is applied, as shown by the arrow F in FIG. 14, the stripper 8 retracts and the pressure in the spring member 32 increases. The stripper 8 travels a distance T, as the spring member 32 is compressed due to the load.

The stock ejector assembly 2 can be assembled to one of the die members 72, 74 of the metal forming die 70. As illustrated in FIGS. 11-12, an aperture 64 can be formed in the lower die member 74 to receive the stock ejector assembly 2. The inner end surface 16 of the spacer 10 contacts a surface 65 of the aperture 64 when the stock ejector assembly 2 is inserted into the aperture 64. A threaded fastener aperture 66 is also machined, tapped, or otherwise formed in the die member 74. The threaded shank 92 of the stock ejector body 4 is used to secure the stock ejector assembly 2 to the die member 74 as illustrated in FIGS. 11 and 12.

Figure 10:
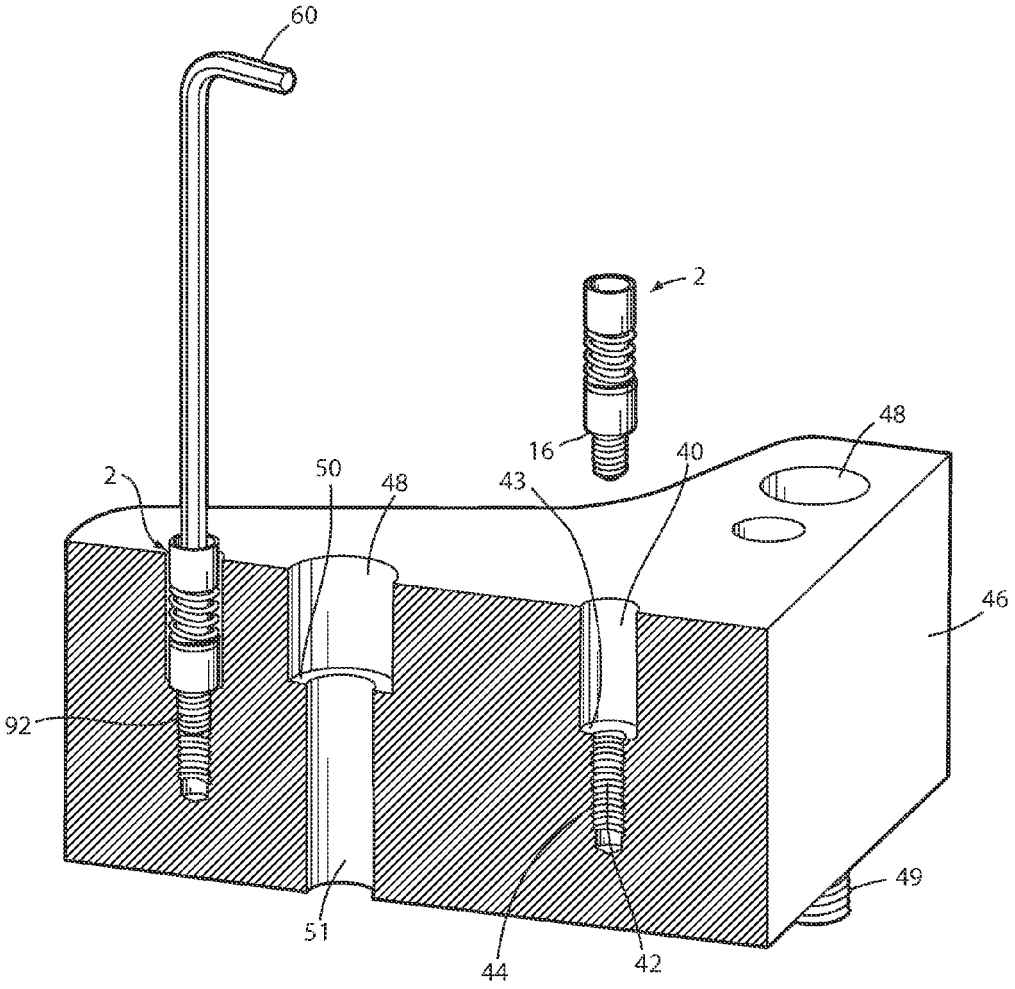
FIG. 10 is a perspective view of the stock ejector assembly being mounted in a die member with a standard hex tool.

As illustrated in FIG. 10, a standard hex tool 60 can be used to install the stock ejector assembly 2 into the die member 74 or into a window 46 that is attached to one of the die members 72, 74. Also as illustrated in FIG. 10, a window mount 46 may be used to facilitate the installation of the stock ejector assembly 2 into the die member 74. The window mount 46 can have an aperture 40 with a threaded portion 44 in a tapered portion of the aperture 40. The threaded shank 92 of the stock ejector assembly 2 is received in threaded portion 44. When the stock assembly 2 is installed, the inner end surface 16 of the spacer 10 is received on an internal shoulder 43 within aperture 40 when the stock ejector 2 assembly is fully installed in the window mount 46. The window mount 46 may be fastened to the die member by the use of fasteners 49 that are received in aperture 48 of the widow mount. A surface on the head of the fastener 49 will engage the shoulder 50 of aperture 48 when the threaded portion of the fastener 49 extends through the lower portion 51 of the aperture 48 and into a threaded hole in the die members 72, 74.

The stock strip 30 is received between the die members 72 and 74 when the die members 72, 74, converge, as illustrated in FIG. 11. When the die members converge, the spring member 32 is compressed. As shown in FIG. 12, when the die members 72, 74 diverge, the spring member 32 decompresses and pushes the stock strip 30 off of the surface of the die member 72. When the stock ejector assembly 2 is installed on the lower die member 74, the stock ejector assembly 2 not only breaks the oil or lubricant adhesion between the die member 74 and the stock strip 30, it also lifts the stock strip 30 for progression within a multi-station progressive metal forming die and/or removal of the finished part form the die assembly.

The term "die member" as used herein refers to any portion of a metal forming die or die set, including, but not limited to, an upper die member or a die shoe, a lower die member or a die shoe, and other die components, whether stationary or reciprocating, including a reciprocating pressure pad, and the like. In the illustrated examples, the stock ejector assembly 2 can be mounted in any die member. The stock ejector assembly 2 can be mounted in other types of die members and/or components and in a variety of different positions and orientations, as will be appreciated by those skilled in the art. In addition, the stock ejector assembly 2 can be used in a single stage die assembly.

Stock ejector assembly 2 has an uncomplicated construction with relatively few components and is therefore quite durable and economical to manufacture. Multiple components of the stock ejector assembly 2 may be formed from a single piece of rigid material. For example, the stripper 8, stock ejector body 2, and optional spacer 10 may have a one-piece construction made from a solid bar of material, such as steel. The fasteners and optional window mount 46 attachment of the stock ejector assembly 2 to an associated die members 72, 74 provides quick and easy installation and removal of the stock ejector assembly 2. The spring member 32 and the stock ejector assembly 2 are backed up or axially supported by the die member itself for greater strength and convenience. Stock ejector assembly 2 positively separates the stock strip from the die during operation of the metal forming die, and provides a very compact, low-profile shape that can be used at various locations and orientations on various die members. The installation of the stock ejector assembly 2 can be achieved with simple machining so as to reduce the installation time and cost. The shape of the stock ejector assembly 2 can be configured so as to accommodate many different applications and users.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. In a multi-station progressive metal forming die having at least two mutually converging and diverging die members between which an elongate stock strip is shifted longitudinally to form parts from the stock strip, the improvement of a stock ejector assembly, comprising:

a stock ejector body with an outer end portion oriented toward the stock strip, an inner end portion oriented away from the stock strip, and a medial portion between the outer end portion and the inner end portion, wherein:

said outer end portion includes a shoulder with an outer end surface and an inner end surface;

said inner end portion includes a threaded shank portion that secures the assembly to one of the die members; and said medial portion includes a shoulder with an outer end surface and an inner end surface;

a stripper with an outer end portion arranged toward the stock strip and an inner end portion oriented away from the stock strip, wherein:

said outer end portion includes an aperture with a first diameter;

said inner end portion includes an aperture with a second diameter, which is less than the first diameter of the outer end portion, forming a generally annular shoulder that engages said inner end surface of the shoulder of the outer end portion of the stock ejector body; and a spring member having a generally hollow interior that is received over said stock ejector body, an outer end oriented toward the stock strip that engages the inner end portion of the stripper, and an opposite inner end oriented away from the stock strip that engages the outer end surface of the shoulder of the medial portion of the stock ejector body.

2. A metal forming die as set forth in claim 1, including:

a spacer having a generally hollow interior that is received over a portion of the threaded shank portion of the inner end portion of the stock ejector body, an outer end surface oriented toward the stock strip that engages the inner end surface of the shoulder of the medial portion of the stock ejector body, and an inner end surface oriented away from the stock strip.

3. A metal forming die as set forth in claim 2, wherein:

said outer end portion of the stock ejector body includes an aperture.

4. A metal forming die as set forth in claim 3, wherein:

said aperture includes a portion shaped to receive a hex tool for installation or removal of the stock ejector assembly from the die member.

5. A metal forming die as set forth in claim 4, wherein:

said stock ejector body includes a taper to the inner end surface of the shoulder of the outer end portion.

6. A metal forming die as set forth in claim 5, wherein:
the aperture in the outer end portion of the stock ejector body includes a tapered surface.

7. A stock ejector assembly for metal forming dies having at least two mutually converging and diverging die members between which parts are formed from a stock strip, comprising:
a stock ejector body with an outer end portion oriented toward the stock strip, an inner end portion oriented away from the stock strip, and a medial portion between the outer end portion and the inner end portion, wherein:
said outer end portion includes a shoulder with an outer end surface and an inner end surface;
said inner end portion includes a threaded shank portion that secures the assembly to one of the die members; and
said medial portion includes a shoulder with an outer end surface and an inner end surface;
a stripper with an outer end portion arranged toward the stock strip and an inner end portion oriented away from the stock strip, wherein:
said outer end portion includes an aperture with a first diameter;
said inner end portion includes an aperture with a second diameter, which is less than the first diameter of the outer end portion, forming a generally annular shoulder that engages said inner end surface of the shoulder of the outer end portion of the stock ejector body; and
a spring member having a generally hollow interior that is received over said stock ejector body, an outer end oriented toward the stock strip that engages the inner end portion of the stripper, and an opposite inner end oriented away from the stock strip that engages the outer end surface of the shoulder of the medial portion of the stock ejector body.

8. A stock ejector assembly as set forth in claim 7, including:
a spacer having a generally hollow interior that is received over a portion of the threaded shank portion of the inner end portion of the stock ejector body, an outer end surface oriented toward the stock strip that engages the inner end surface of the shoulder of the medial portion of the stock ejector body, and an inner end surface oriented away from the stock strip.

9. A stock ejector assembly as set forth in claim 8, wherein:
said outer end portion of the stock ejector body includes an aperture.

10. A stock ejector assembly as set forth in claim 9, wherein:
said aperture includes a portion shaped to receive a hex tool for installation or removal of the stock ejector assembly from the die member.

11. A stock ejector assembly as set forth in claim 10, wherein:
said stock ejector body includes a taper to the inner end surface of the shoulder of the outer end portion.

12. A stock ejector assembly as set forth in claim 11, wherein:
the aperture in the outer end portion of the stock ejector body includes a tapered surface.

13. In a method for making a multi-station progressive metal forming die having at least two mutually converging and diverging die members between which an elongate stock strip is shifted longitudinally to form parts from the stock strip, with the improvement of at least one stock ejector assembly, comprising:
forming a stock ejector body with an outer end portion oriented toward the stock strip, an inner end portion oriented away from the stock strip, and a medial portion between the outer end portion and the inner end portion, including:
forming said outer end portion includes a shoulder with an outer end surface and an inner end surface;
forming said inner end portion includes a threaded shank portion that secures the assembly to one of the die members; and
forming said medial portion includes a shoulder with an outer end surface and an inner end surface;
forming a stripper with an outer end portion arranged toward the stock strip and an inner end portion oriented away from the stock strip, including:
forming said outer end portion includes an aperture with a first diameter;
forming said inner end portion includes an aperture with a second diameter, which is less than the first diameter of the outer end portion, forming a generally annular shoulder that engages said inner end surface of the shoulder of the outer end portion of the stock ejector body;
selecting a spring member with a generally hollow interior, an outer end oriented toward the stock strip, and an opposite inner end oriented away from the stock strip;
inserting said spring member over said outer end portion of the stock ejector body with the inner end of the spring member engaging the outer end surface of the shoulder of the medial portion of the stock ejector body;
inserting the stripper over said outer end portion of the stock ejector body;
inserting a tool into the stripper;
moving the tool toward the inner end portion of the stock ejector body, thereby compressing the stock ejector assembly, allowing the inner end portion of the stripper moves past the shoulder of the outer end portion of the stock ejector body;
removing the tool to permit the spring to push the stripper toward the outer end of the stock ejector body, allowing the annular shoulder of the stripper to engage the inner end surface of the shoulder of the outer end portion of the stock ejector body; and
securing the stock ejector assembly to one die member.

14. A method for making a multi-station progressive metal forming die as set forth in claim 13, wherein:
said securing step includes securing at least a portion of the threaded shank portion of the inner end portion of the stock ejector body fastener into a threaded aperture formed in said one die member.

15. A method for making a multi-station progressive metal forming die as set forth in claim 13, wherein:
said securing step includes securing at least a portion of the threaded shank portion of the inner end portion of the stock ejector body fastener into a threaded aperture formed in a window mount that is attached to said one die member.

16. A method for making a multi-station progressive metal forming die as set forth in claim 13, including:
selecting a spacer having a generally hollow interior, an outer end surface oriented toward the stock strip, and an inner end surface oriented away from the stock strip; and inserting the spacer over a portion of the threaded shank portion of the inner end portion of the stock ejector body such that the outer end surface of the spacer engages the inner end surface of the shoulder of the medial portion of the stock ejector body.

17. A method for making a multi-station progressive metal forming die as set forth in claim 13, wherein:

the stock ejector body has a one-piece construction formed from a solid bar of rigid material.

18. A method for making a multi-station progressive metal forming die as set forth in claim 17, wherein:

said stock ejector body forming step includes forming a tapered surface to the inner end surface of the shoulder of the outer end portion.

19. A method for making a multi-station progressive metal forming die as set forth in claim 13, wherein:

said stock ejector body forming step includes forming an aperture in said outer end portion of the stock ejector body.

20. A method for making a multi-station progressive metal forming die as set forth in claim 19, wherein:

said aperture forming step includes forming a portion shaped to receive a hex tool for installation or removal of the stock ejector assembly from the die member.

* * * * *